US005519597A

United States Patent [19]

Tsai

[11] Patent Number: 5,519,597

[45] Date of Patent: May 21, 1996

[54] ELEVATION MECHANISM FOR LAMP DEVICE

[76] Inventor: Wen-Hwa Tsai, 58, Ma Yuan West St., Taichung, Taiwan

[21] Appl. No.: 381,450

[22] Filed: Jan. 30, 1995

[51] Int. Cl.[6] ..... F21V 21/00

[52] U.S. Cl. ..... 362/386; 362/403; 362/407; 362/418; 248/328

[58] Field of Search ..... 362/386, 403, 362/404, 407, 418; 248/327, 328, 329

[56] References Cited

U.S. PATENT DOCUMENTS 2,609,170 9/1952 Farrington et al. ..... 362/403

5,420,772 5/1995 Evans ..... 362/386

FOREIGN PATENT DOCUMENTS 403664 9/1909 France ..... 362/403

*Primary Examiner*—Denise L. Gromada
*Assistant Examiner*—Sara Sachie Raab

[57] ABSTRACT

An elevation mechanism for moving a lamp includes a motor secured in a housing and having a spindle. A board is disposed below the housing and connected to the spindle by a cable. The cable is wound on and unwound from the spindle in order to move the board upward and downward when the motor is energized. A lamp is coupled to the board. The lamp is moved upward and downward for repairing purposes when the motor is energized.

1 Claim, 3 Drawing Sheets

ELEVATION MECHANISM FOR LAMP DEVICE

BACKGROUND OF THE INVENTION

1. Field of the Invention

The present invention relates to an elevation mechanism, and more particularly to an elevation mechanism for elevating lamp devices.

2. Description of the Prior Art

Typically, lamp devices are secured to the ceiling portion of the rooms. When the lamp devices are damaged and are required to be repaired, the users have to use a ladder to reach the lamp device for repairing the lamp devices.

The present invention has arisen to mitigate and/or obviate the afore-described disadvantages of the conventional lamp devices.

SUMMARY OF THE INVENTION

The primary objective of the present invention is to provide an elevating mechanism for moving the lamp devices upward and downward for repairing purposes.

In accordance with one aspect of the invention, there is provided an elevation mechanism for lamp means comprising a housing, a motor secured in the housing and including a spindle, a board provided below the housing, cable means securing the board to the spindle, the cable means being wound on and unwound from the spindle in order to move the board upward and downward when the motor is energized, and lamp means coupled to the board. The lamp means is moved upward and downward for repairing purposes when the motor is energized.

The board includes a bottom having a first ring secured thereto, the lamp means includes an upper portion having a second ring provided thereon for engaging with the first ring so as to be secured to the board.

A plurality of rings are engaged on the cable means, an electric wire is engaged with the rings and connected to the lamp means, and a plurality of weight members are secured on the electric wire and engaged between the rings for retaining the electric wire in place.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1A:
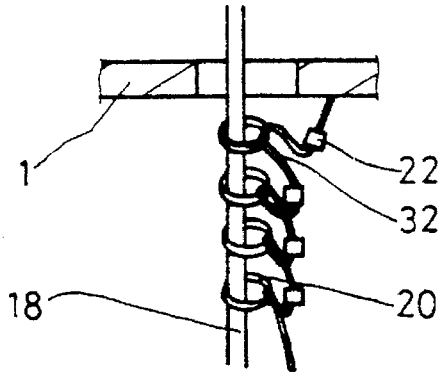
FIG. 1A is a partial perspective view showing portion of the elevation mechanism.
Figure 1:
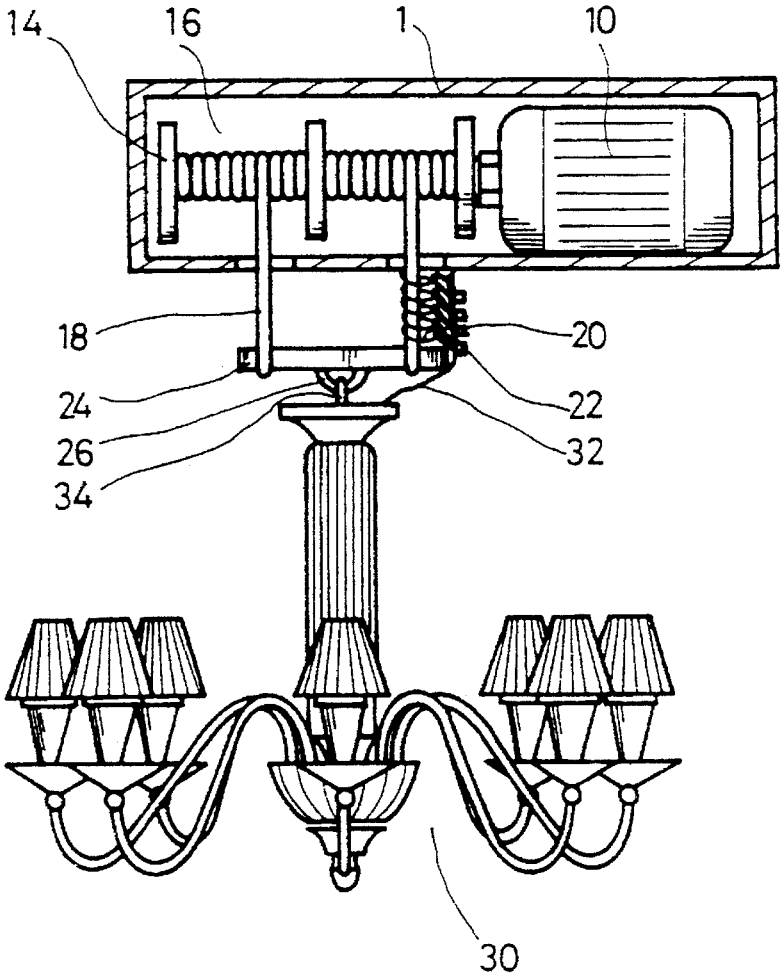
FIG. 1 is a plane view of an elevation mechanism for a lamp device in accordance with the present invention.
Figure 2:
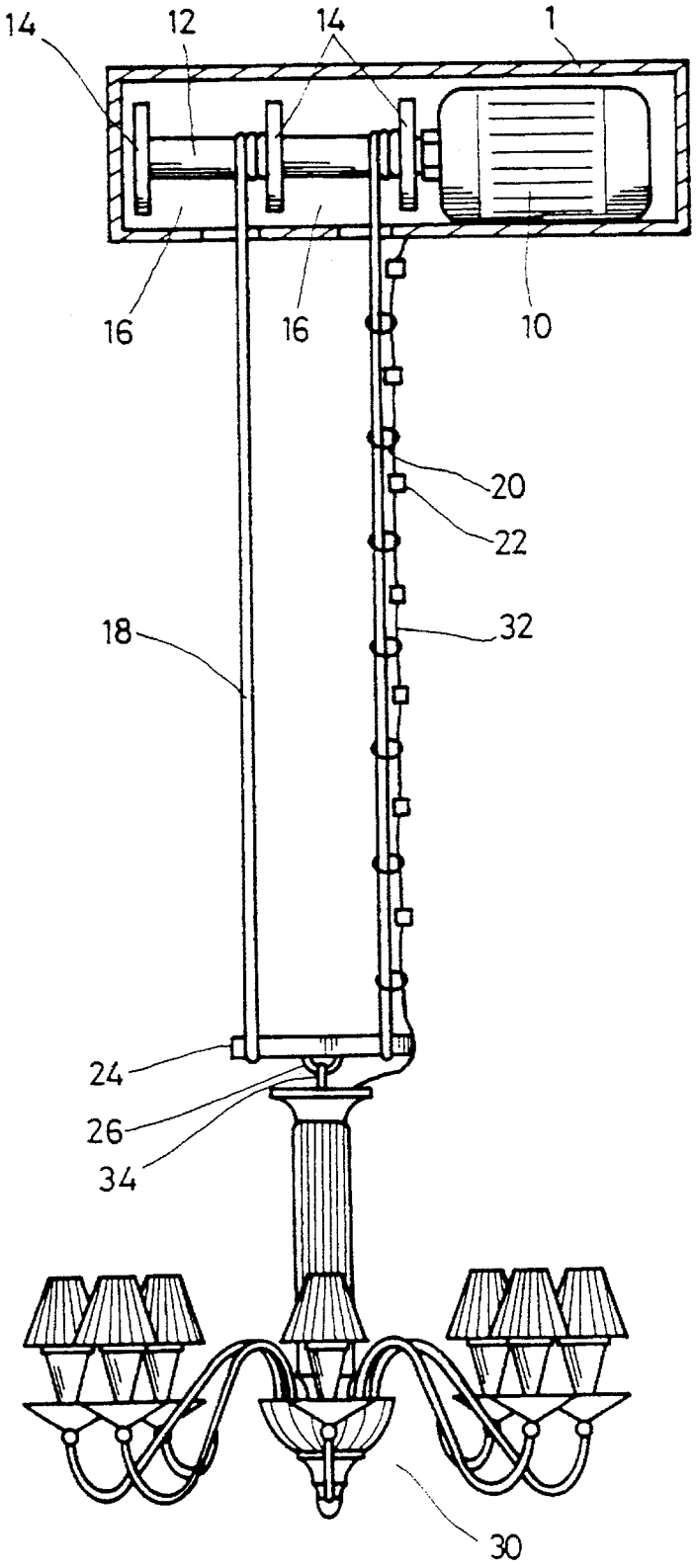
FIGS. 2 and 3 are plane views illustrating the operation of the elevation mechanism.

Referring to the drawings, and initially to FIGS. 1, 1A and 2, an elevation mechanism in accordance with the present invention is provided for moving a lamp means upward and downward for repairing purposes and comprises a housing 1 having a motor 10 provided therein. The motor 10 includes a spindle 12 extended in the housing 1 and having three discs 14 secured thereon so as to define two spaces 16. Two cables 18 include an upper end fixed to the spindle 12 and engaged in the spaces 16 respectively and include a lower end secured to a board 24. The cables 18 can be wound around the spindle 12 and stored within the spaces 16 respectively when the spindle 12 is rotated by the motor 10. A number of rings 20 are engaged on one of the cables 18 for engaging with and for retaining an electric wire 32 in place. A number of weights 22 are secured on the electric wire 32 and engaged between the rings 20 for suitably engaging the electric wire 32 with the rings 20, best shown in FIG. 1A. Another ring 26 is fixed on the bottom of the board 24. A lamp means 30 includes a ring 34 engaged with the ring 26. The electric wire 32 connects the lamp means 30 to the electric power source.

In operation, when the spindle 12 is rotated by the motor 10, the cables 18 are unwound from the spindle 12 so as to lower the lamp means 30 for repairing purposes. The lamp means 30 may also be moved upward when the motor 10 rotates in opposite direction.

Figure 3:
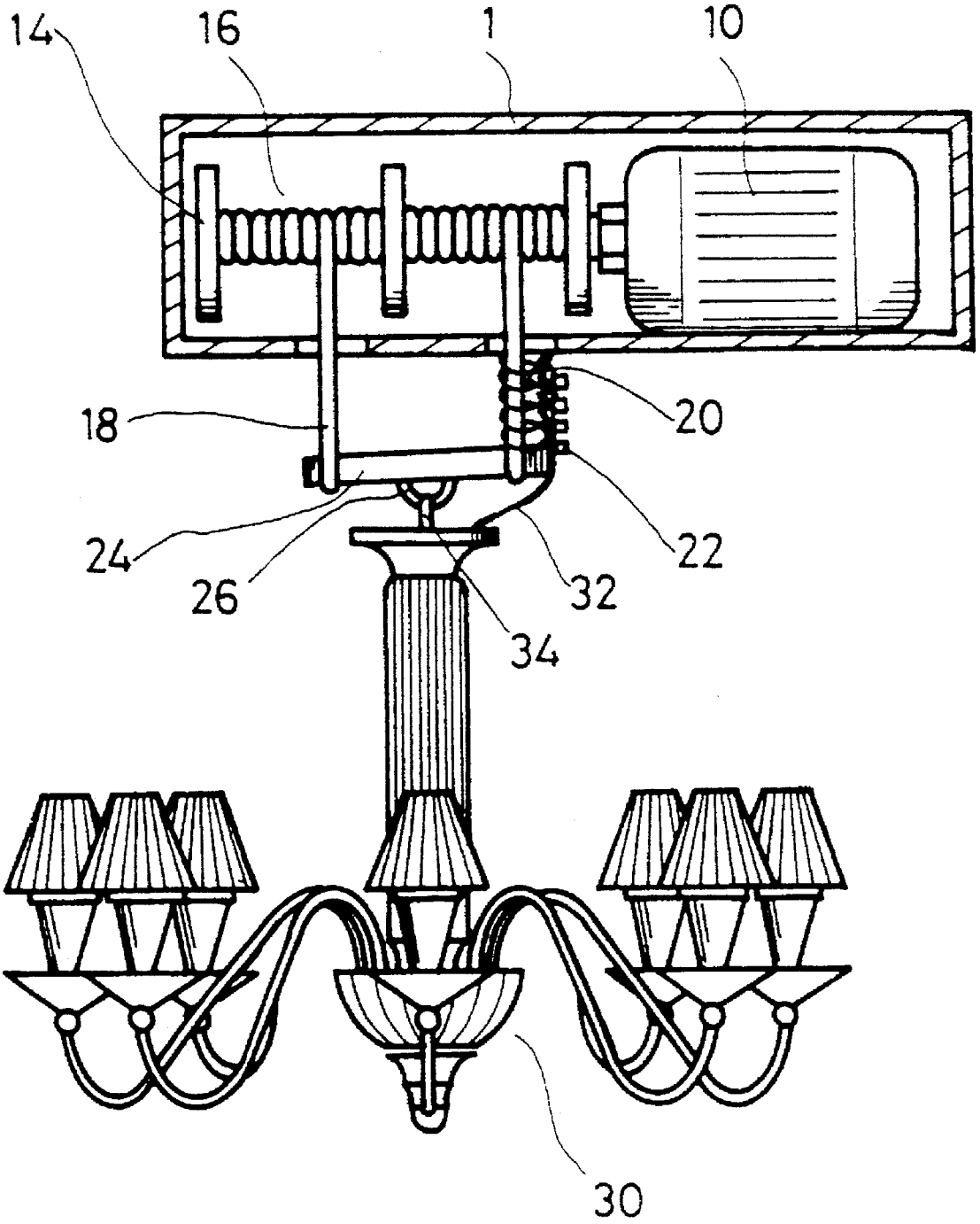

Referring next to FIG. 3, when the board 24 is not balanced due to different length of the two cables 18, the ring 34 may moved to the lowest position of the ring 26 such that the lamp means 30 may also be stably retained in place.

Accordingly, the elevation mechanism in accordance with the present invention may move the lamp means upward and downward for repairing purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An elevation mechanism for lamp means comprising:

a housing;

a motor secured in said housing and including a spindle;

a board provided below said housing;

cable means securing said board to said spindle, said cable means being wound on and unwound from said spindle in order to move said board upward and downward when said motor is energized;

lamp means coupled to said board;

said lamp means being moved upward and downward for repairing purposes when said motor is energized;

said board including a bottom having a first ring secured thereto;

said lamp means including an upper portion having a second ring provided thereon for engaging with said first ring so as to be secured to said board;

a plurality of rings engaged on said cable means;

an electric wire engaged with said rings and connected to said lamp means; and a plurality of weight members secured on said electric wire and engaged between said rings for retaining said electric wire in place.

* * * * *